US011297890B2

(12) United States Patent
Tutunaru

(10) Patent No.: US 11,297,890 B2
(45) Date of Patent: Apr. 12, 2022

(54) FOOTBALL HELMET

(71) Applicant: IMPACT SOLUTION LLC, Los Angeles, CA (US)

(72) Inventor: Catalin Tutunaru, Cape Elizabeth, ME (US)

(73) Assignee: Impact Solutions LLC, Las Vegas, NV (US)

( * ) Notice: Subject to any disclaimer, the term of this patent is extended or adjusted under 35 U.S.C. 154(b) by 0 days.

(21) Appl. No.: 16/088,744

(22) PCT Filed: Mar. 27, 2016

(86) PCT No.: PCT/US2016/024395
§ 371 (c)(1),
(2) Date: Sep. 26, 2018

(87) PCT Pub. No.: WO2017/171694
PCT Pub. Date: Oct. 5, 2017

(65) Prior Publication Data

US 2020/0163399 A1 May 28, 2020

(51) Int. Cl.
*A42B 3/06* (2006.01)

(52) U.S. Cl.
CPC ..... *A42B 3/063* (2013.01)

(58) Field of Classification Search
CPC ..... A42B 3/20
See application file for complete search history.

(56) References Cited

U.S. PATENT DOCUMENTS

| | | | | | |
|---|---|---|---|---|---|
| 2,296,335 | A | | 9/1942 | Brady | |
| 3,113,318 | A | | 12/1963 | Marietta | |
| 3,117,679 | A | | 1/1964 | Miers | |
| 3,174,155 | A | | 3/1965 | Pitman | |
| 3,186,004 | A | | 6/1965 | Carlini | |
| 3,242,500 | A | | 3/1966 | Derr | |
| 3,314,077 | A | * | 4/1967 | Marchello | A42B 3/085 2/421 |
| 3,720,955 | A | * | 3/1973 | Rawlings | A42B 3/127 2/415 |
| 3,992,721 | A | * | 11/1976 | Morton | A42B 3/12 2/414 |

(Continued)

FOREIGN PATENT DOCUMENTS

| | | | | |
|---|---|---|---|---|
| EP | 790787 B1 | | 9/2000 | |
| GB | 2463258 A | * | 3/2010 | A42B 3/0473 |

(Continued)

OTHER PUBLICATIONS

International Search Report dated Jun. 16, 2016 from corresponding PCT/US2016/024395, pp. 2.

(Continued)

*Primary Examiner* — Jocelyn Bravo
(74) *Attorney, Agent, or Firm* — Law Offices of Daniel A. Tesler, LLC

(57) ABSTRACT

The present invention is a football helmet designed to reduce the occurrence of concussions and subconcussive impacts to the brain through use of a novel exterior shape and sandwich of materials. The present invention also reduces the occurrence of neck injuries through the use of a flexible neck support that provides protection against frontal impacts without restricting a player's range of motion.

19 Claims, 7 Drawing Sheets

(56) References Cited

U.S. PATENT DOCUMENTS 4,075,717 A 2/1978 Lemelson
4,124,904 A 11/1978 Matthes
4,223,409 A 9/1980 Lee
4,627,114 A 12/1986 Mitchell
4,903,346 A * 2/1990 Reddemann ..... A42B 3/125 2/411
4,937,888 A 7/1990 Straus
5,073,271 A 12/1991 Sander et al.
5,117,679 A 6/1992 Lewtas et al.
5,477,563 A 12/1995 Gentes et al.
6,073,271 A 6/2000 Alexander et al.
6,314,586 B1 11/2001 Duguid
6,421,840 B1 7/2002 Chen et al.
6,446,270 B1 * 9/2002 Durr ..... A42B 3/061 2/412
6,468,644 B1 * 10/2002 Hong ..... A42B 3/061 428/297.7
6,640,267 B1 10/2003 Raza
6,854,133 B2 2/2005 Lee et al.
7,328,462 B1 * 2/2008 Straus ..... A42B 3/067 2/411
8,117,679 B2 2/2012 Pierce
8,615,817 B2 12/2013 Phillips
8,640,267 B1 * 2/2014 Cohen ..... A42B 3/063 2/411
8,739,317 B2 6/2014 Abernethy
8,938,817 B1 * 1/2015 Baldi ..... A42B 3/069 2/411
9,220,311 B1 * 12/2015 Baldi ..... A42B 3/00
9,683,622 B2 6/2017 Ferrara
9,737,106 B1 8/2017 Cannon, Jr.
9,795,180 B2 10/2017 Lowe et al.
9,861,153 B2 1/2018 Finisdore
9,943,129 B2 4/2018 Newman et al.
10,010,127 B1 * 7/2018 Shaffer ..... A42C 2/002
10,362,829 B2 * 7/2019 Lowe ..... A42B 3/064
10,463,099 B2 * 11/2019 Allen ..... A42B 3/064
10,561,189 B2 * 2/2020 Lee ..... A42B 3/121
2003/0200597 A1 * 10/2003 Dennis ..... A42B 3/063 2/410
2004/0168246 A1 * 9/2004 Phillips ..... A42B 3/064 2/411
2005/0273911 A1 * 12/2005 Skiba ..... A42B 3/063 2/412
2006/0059605 A1 * 3/2006 Ferrara ..... A42B 3/064 2/410
2006/0059606 A1 * 3/2006 Ferrara ..... A01N 25/18 2/412
2007/0000022 A1 * 1/2007 Jacobsen ..... A42B 3/14 2/171
2008/0155735 A1 7/2008 Ferrara
2009/0044316 A1 2/2009 Udelhofen
2009/0260133 A1 * 10/2009 Del Rosario ..... A42B 3/062 2/412
2010/0088807 A1 4/2010 Jeong et al.
2010/0269246 A1 * 10/2010 Salomon ..... A42B 3/127 2/414
2012/0017358 A1 1/2012 Princip et al.
2012/0177869 A1 7/2012 Micarelli
2013/0133128 A1 5/2013 Hein et al.
2013/0174329 A1 7/2013 Hanson et al.
2013/0254978 A1 10/2013 McInnis et al.
2013/0340147 A1 * 12/2013 Giles ..... A42B 3/00 2/412
2014/0259316 A1 9/2014 Katz
2015/0000011 A1 1/2015 Redpath et al.
2015/0089721 A1 4/2015 Hanna
2015/0101899 A1 * 4/2015 Russo ..... B33Y 80/00 188/266
2015/0223546 A1 * 8/2015 Cohen ..... A42B 3/063 2/412
2015/0305430 A1 * 10/2015 Rush ..... A42B 3/124 2/412
2015/0359288 A1 * 12/2015 Woxing ..... A42B 3/063 2/412
2016/0113348 A1 4/2016 Twardowski, Jr. et al.
2016/0120238 A1 5/2016 Duncan et al.
2016/0270471 A1 9/2016 Merrell
2016/0324247 A1 11/2016 Warmouth et al.
2017/0065018 A1 * 3/2017 Lindsay ..... A42B 3/067
2017/0127748 A1 5/2017 Sethumadhavan et al.
2017/0232327 A1 8/2017 Kuntz
2017/0265557 A1 * 9/2017 Mercado, Jr ..... A42B 3/16
2017/0303612 A1 10/2017 Morgan
2017/0303622 A1 * 10/2017 Stone ..... A42B 3/064
2018/0132557 A1 * 5/2018 Torres ..... A42B 3/063
2018/0213875 A1 8/2018 Tutunaru
2018/0326288 A1 * 11/2018 Simpson ..... A42B 3/063
2019/0001650 A1 1/2019 Sohn et al.
2019/0014848 A1 1/2019 Tutunaru
2019/0029353 A1 * 1/2019 Ogata ..... A42B 3/283

FOREIGN PATENT DOCUMENTS

WO 2000035307 A1 6/2000
WO 2017001619 A1 1/2017
WO 2017171694 A1 10/2017
WO 2018144420 A1 8/2018

OTHER PUBLICATIONS

International Written Opinion dated Jun. 16, 2016 from corresponding PCT/US2016/024395, pp. 5.
International Search Report and Written Opinion, PCT/US2018/015852, dated May 23, 2018, 12 pages.
Sprenger, Stephan et al., Carbon fiber-reinforced composites using an epoxy resin matrix modified with reactive liquid rubber and silica nanoparticles, Dec. 10, 2014, ScienceDirect, vol. 105, pp. 86-95 (Year: 2014).

* cited by examiner

FOOTBALL HELMET

FIELD OF THE INVENTION

The present invention relates to helmets, in particular, to football helmets.

BACKGROUND OF THE INVENTION

In recent years, there has been a significant amount of research into the health risks associated with repetitive head trauma. In the game of American football ("football"), players are subjected to player-to-player contact and it is not uncommon for a player's head to strike the ground or another player. To prevent injuries to the head and face, football players wear a helmet with a hard shell, internal padding and a wire face guard. While the football helmets in the prior art generally protect players from broken bones and abrasions in their head and face, they are inadequate at protecting players from internal injuries, specifically injuries to the brain.

Studies have indicated that football players are susceptible to developing chronic traumatic encephalopathy ("CTE"), which is a degenerative disease that has been attributed to repetitive concussions or subconcussive impacts to the brain. Instead of preventing the concussions and subconcussive impacts that are theorized to cause CTE, the football helmets in the prior art can exacerbate trauma to the brain in certain impacts. For instance, when football players have head-to-head contact, the hard shell of prior art football helmets create a nearly elastic collision where the kinetic energy of the two helmets before the collision is nearly equal to their kinetic energy after the collision. This effect is similar to a first moving pool ball hitting a second stationary pool ball—after the impact, the first ball becomes stationary and the second ball begins to move at approximately the same rate as the first ball originally was moving. When football players experience head-to-head contact, the force of the impact is not absorbed by the prior art helmets, but rather, like a pool ball, the force is conserved and exerted on one or more player's head.

By not absorbing the energy of impacts, but instead conserving the energy, the football helmets in the prior art do not adequately protect the brain from concussions and subconcussive impacts. The nearly elastic collisions that are characteristic of the prior art football helmets also amplify the magnitude of force exerted on the neck and brain stem of players, potentially causing neck injuries or other brain injuries that are not yet known.

While prior art football helmets have a layer of padding inside the hard shell, the design of the padding is not adequate to support the head in an impact. The internal padding of a helmet is most effective when there is no gap between a player's head and the padding. In the prior art helmets, the padding often has gaps between the padding and a player's head unless the helmets are custom designed for that player's head. As most players are unable to purchase a helmet with padding custom designed for their head, most players have gaps between the padding and their head, reducing the effectiveness of the prior art helmet systems.

The helmets in the prior art also provide an inadequate amount of neck protection against the head rotating rearward from a frontal hit. Some football positions use bulky and uncomfortable neck supports, but most players on the field have no protection against damage to their neck and brain stem in a hard frontal hit.

Therefore, there is a need for a football helmet that is better able to prevent the brain from receiving concussions and subconcussive impacts. There is also a need for a helmet that reduces the prevalence of gaps between a player's head and the internal padding of the helmet. There is also a need for a helmet that incorporates a neck support to reduce the rotation of a player's head rearward in a frontal impact. Accordingly, it is the object of the present invention to provide a football helmet that prevents the brain from receiving concussions and reduces the magnitude of subconcussive impacts, that reduces the prevalence of gaps between a player's head and the internal padding of the helmet and that incorporates a neck support.

BRIEF SUMMARY OF THE INVENTION

The present invention provides a football helmet that reduces the occurrence of concussions and the severity of subconcussive impacts to the brain when worn by football players. Football is not the only sport where CTE is a problem and other sports and activities would also benefit from the invention disclosed herein. The invention uses a new exterior profile as well as a new sandwich of materials to reduce the magnitude of impacts to the head, brain and neck.

The present invention uses a new exterior profile that is subtly cone shaped when viewed from the side or front. The subtle cone shaped exterior of the invention decreases the occurrence of nearly elastic collisions when compared to the nearly spherical helmets in the prior art. The position of the cone's rounded apex is positioned to the rear of the top of the helmet relative to a user when viewed from the side. The precise height and location of the rounded apex can be adjusted to suit a player's weight and helmet size.

The present invention also uses a combination of materials that is new to the field of football helmets. To reduce the prevalence of elastic collisions, the present invention uses a durable, yet easily compressible material over the exterior surface that is capable of absorbing the force of an impact. The present invention uses a rigid inner layer to provide structure to the helmet and protect against head injuries during high pressure impacts. Over the inner layer of the helmet is a compressible layer that conforms to a player's head, eliminating gaps between the lining and the player's head. The inner layer also absorbs the force of impact so that impacts are absorbed by both the outer and inner layers of the helmet.

The embodiment presented in this application are optimized for use in a football helmet, however, it is appreciated that the invention could be used in other types of helmets within the inventive concept expressed herein.

DETAILED DESCRIPTION OF THE INVENTION

Figure 1:
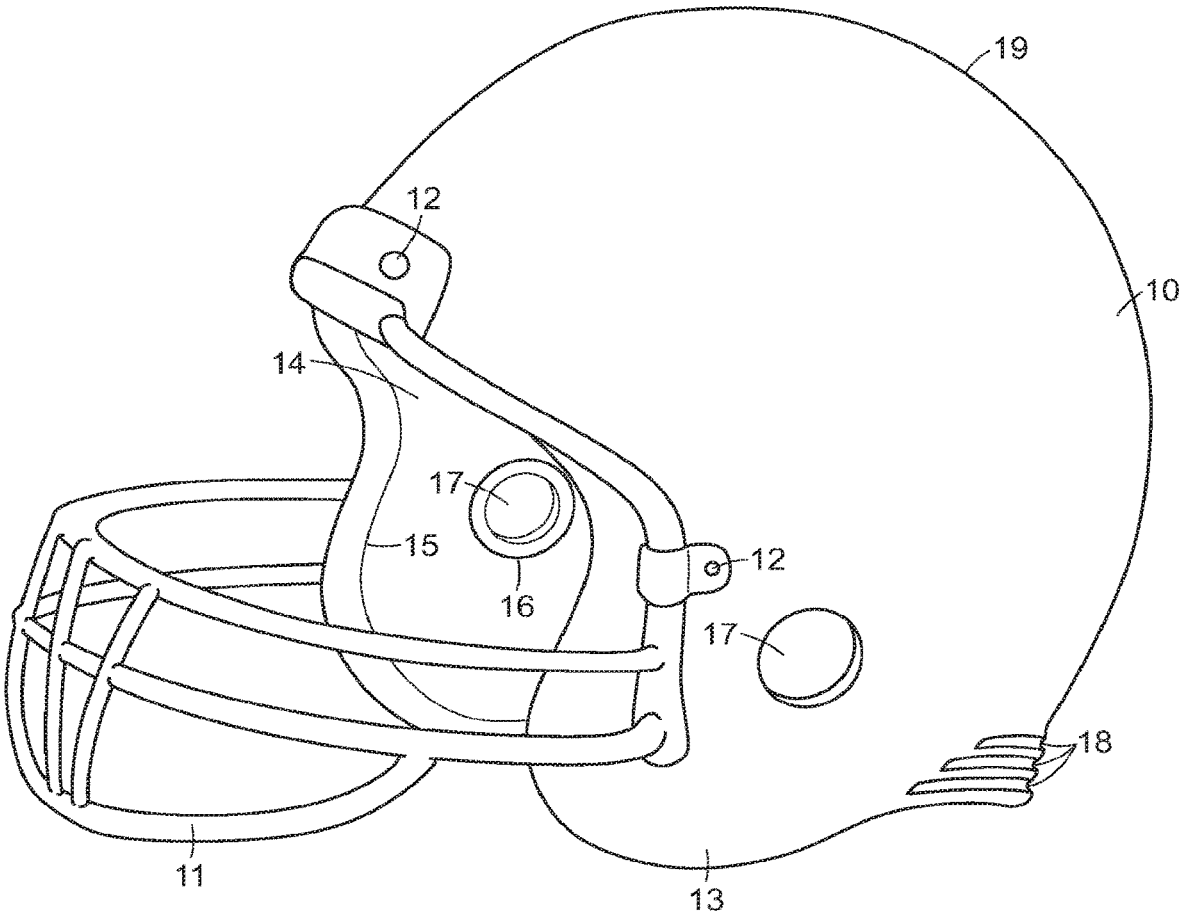
FIG. 1 is a perspective view of the invention with a facemask attached.

In FIG. 1 is a perspective view of the invention comprising a football helmet 10 with a novel shape and sandwich of materials. In this view, a facemask 11 is attached to the helmet 10 using facemask mounted snaps 12. In the preferred embodiment, the facemask 11 is comprised of carbon fiber to reduce the overall weight of the helmet.

Visible in FIG. 1 is the outer layer 13 of the helmet 10 and the inner layer 14. The outer layer 13 covers the exterior of the helmet and meets the inner layer 14 at a seam 15 on the inside edge of the helmet and at a seam 16 on the inside edge of each ear hole 17. At the portion of the helmet 10 closest to a person's neck, the outer layer 13 contains multiple grooves 18 that are roughly parallel to the ground when the helmet is upright. The grooves 18 allow the helmet 10 to flex near the neck, providing support to the neck in a frontal impact without restricting a player's range of motion. Also visible in FIG. 1 is the subtle cone shape of the helmet with a rounded apex 19 positioned to the rear of the top of the helmet relative to a user when viewed from the side.

Figure 2:
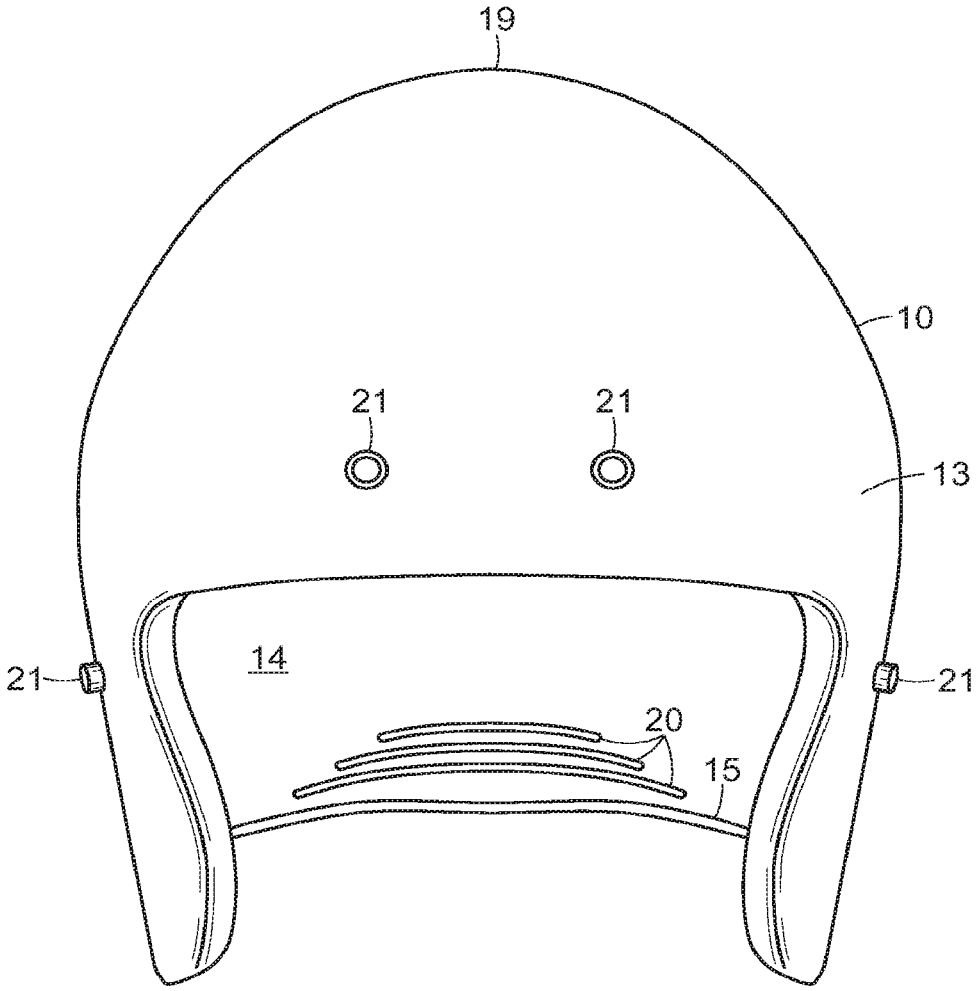
FIG. 2 is a front view of the invention without a facemask attached.

FIG. 2 is a front view of the helmet 10 without a facemask attached. Visible in this view is the outer layer 13 and the inner layer 14. The seam 15 between the outer layer 13 and inner layer 14 is shown in this view as it continues along the inside edge of the helmet 10. The inner layer 14 contains multiple grooves 20 that are similar to the grooves 18 in the outer layer 13. The inner grooves 20 are roughly parallel to the ground when the helmet is upright and allow the helmet 10 to flex near the neck to provide support without restricting a player's range of motion.

On the front of the helmet, four helmet mounted snaps 21 extend through the outer layer 13 to provide a location for the facemask mounted snaps 12 to attach. The apex 19 is located substantially on the centerline of the helmet when viewed from the front so that the right half and the left half of the helmet are substantially mirror images of each other.

Figure 3:
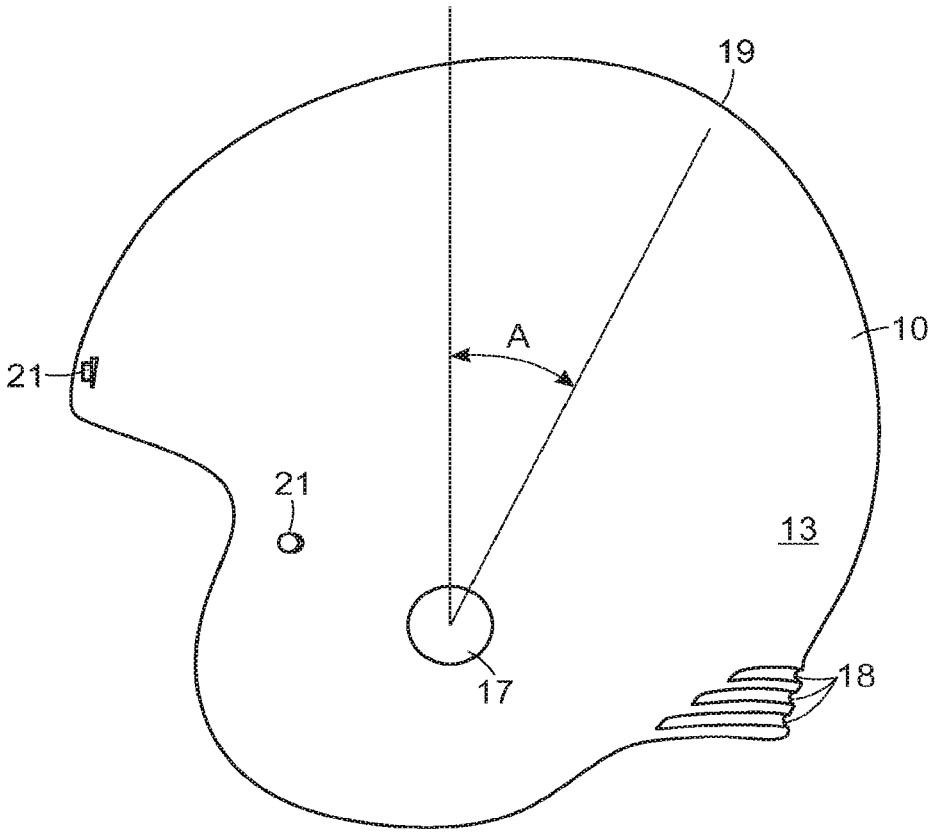
FIG. 3 is a left side view of the invention without a facemask attached. The left side and right side of the invention are substantially mirror images of each other.

FIG. 3 is a left side view of the helmet 10 without a facemask attached. Only the outer layer 13 is visible in this view because the seams 15 and 16 are on the inside edges of the helmet 10 and on the inside edge of the ear holes 17. Two of the helmet mounted snaps 21 are visible in this view, extending through the outer layer 13. The side profile of the grooves 18 are visible in this view and show the curved profile of the grooves in the preferred embodiment. Various types of reliefs or a reduction in the thickness of the outer layer 13 could be used to increase the flexibility of the material in the neck area. In addition, the use of a different material at the neck area could provide more or less rigidity as required.

The location of apex 19 is best defined in the side view of FIG. 3. The position of the cone's rounded apex is positioned to the rear of the top of the helmet relative to a user when viewed from the side. Using a vertical line originating from the center of the ear hole 17, and a line originating from the center of the ear hole 17 and intersecting the helmet at the apex 19, Angle "A" defines the angle between the two lines at the center of the ear hole. The apex 19 provides the most impact deflection when located at a point rearward of the vertical line so that the apex 19 is most effective when Angle "A" is greater than zero. In the preferred embodiment shown in this application, Angle "A" is approximately 25 degrees. The ideal location of the apex 19 depends on the weight of the player and the height of the apex above the outer surface of the helmet. In various embodiments, the location of the apex 19 is effective when Angle "A" is between zero and 35 degrees.

Figure 4:
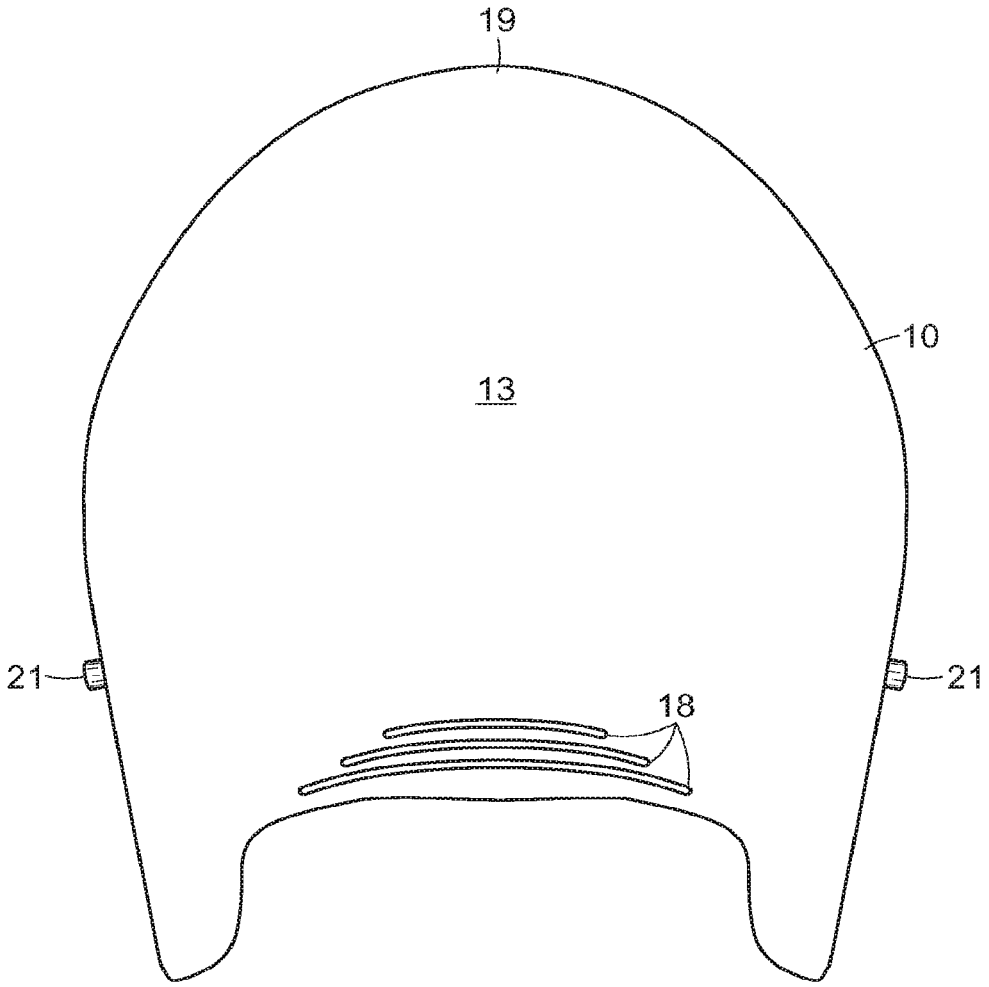
FIG. 4 is a rear view of the invention without a facemask attached.

FIG. 4 is a rear view of the helmet 10 without a facemask attached. Similar to FIG. 3, only the outer layer 13 is visible in this view because the seams 15 and 16 are on the inside edges of the helmet 10 and on the inside edge of the ear holes 17. Two of the helmet mounted snaps 21 are visible in this view where they extend through the outer layer 13.

The rear view of the outer grooves 18 can be seen in this view. The outer grooves 18 generally follow the bottom edge of the rear of the helmet 10 and are generally parallel to the ground when the helmet is upright. The apex 19 of the helmet 10 is located on the centerline of the helmet.

Figure 5:
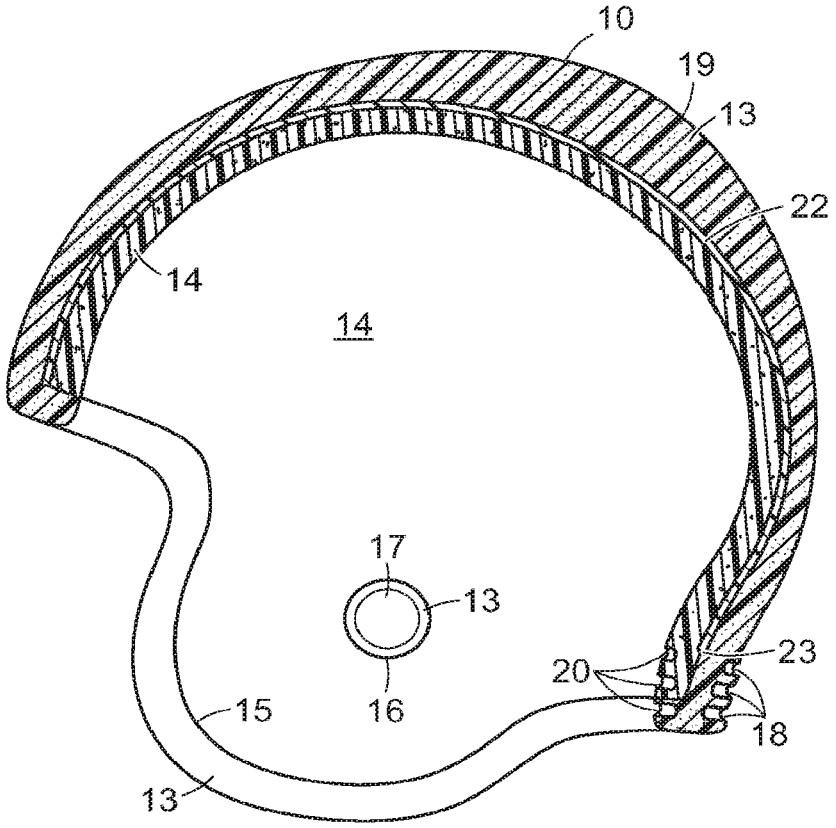
FIG. 5 is a left side sectioned view of the invention without a facemask attached.

In FIG. 5 is a left side sectioned view of the helmet 10 showing the sandwich of materials that is part of the invention. The inner layer 14 is an impact absorbent material designed to eliminate gaps between a player's head and the helmet and to cushion impacts. The outer layer 13 is also an impact absorbent material, but it is designed to resist abrasions and allow the application of a surface color or design. Between the outer layer 13 and inner layer 14 is a rigid core 22 that provides structure to the helmet and protection against larger impacts to the head.

Shown in the sectioned view is the detail of the seam 15 where the outer layer 13 and inner layer 14 meet. The rigid core 22 ends before the edge of the helmet 10 and the outer layer 13 rolls about the edge to meet the inner layer 14 on the inner edge of the helmet 10. At the base of the helmet above the neck, the rigid core 22 ends at a point 23 above the outer grooves 18 and inner grooves 20. Because the rigid core 22 is not flexible, only the outer layer 13 and inner layer 14 are present below point 23 to allow the helmet to flex with a player's movements. While a sectioned view of the seam 16 around the ear holes 17 is not provided, it is substantially similar to the sectioned view of the seam 15 about the edge of the helmet 10.

In the preferred embodiment, the inner layer 14 is comprised of viscoelastic polyurethane foam ("viscoelastic foam"). This material is also known as low-resilience polyurethane foam, memory foam or temper foam, along with other names. Viscoelastic foam is pressure and temperature sensitive and quickly molds to the contour of an object pressed against it. Viscoelastic foam's ability to mold around the contour of an object makes it an ideal material for the interior of a helmet. It's use inside a helmet allows the same helmet to contour to multiple players and eliminate gaps between the inner layer 14 and a player's head without resorting to an expensive helmet customization process.

Viscoelastic foam also provides effective impact cushioning and temperature control. Viscoelastic foam is excellent at absorbing impact and when used as the inner layer 14, provides impact absorption between a player's head and the rigid core 22. Viscoelastic foam also stabilizes the temperature of objects placed against it. It tends to absorb and release heat slowly, allowing the material to stabilize the temperature of a player's skin.

More specifically, the preferred invention uses an inner layer 14 comprised of a viscoelastic foam with gel-like properties, an open cell structure and a soft dough-like consistency. Viscoelastic foam with a density between 15 and 50 pounds per cubic foot is particularly effective at maintaining its shape when worn by a user and providing effective impact cushioning. An important characteristic of the material used in the preferred embodiment is that it is capable of easily mold around a user's head to eliminate gaps.

Figure 7A:
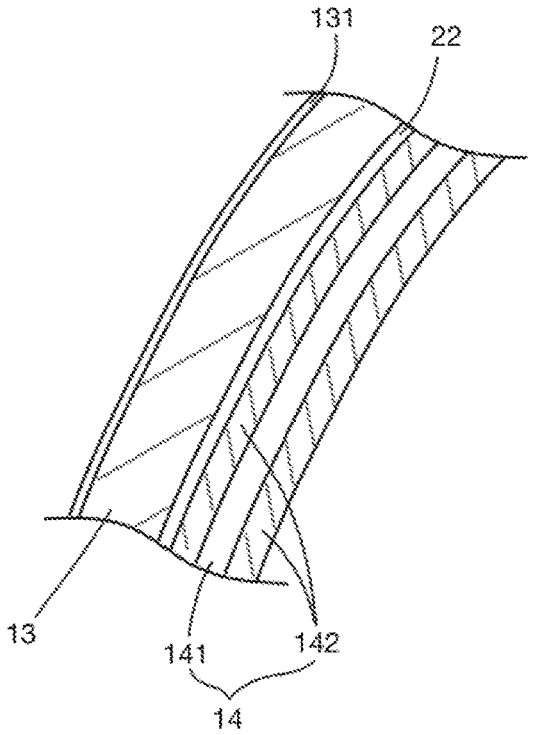
FIGS. 7A and 7B are schematic views showing the layers used in the invention.
Figure 7B:
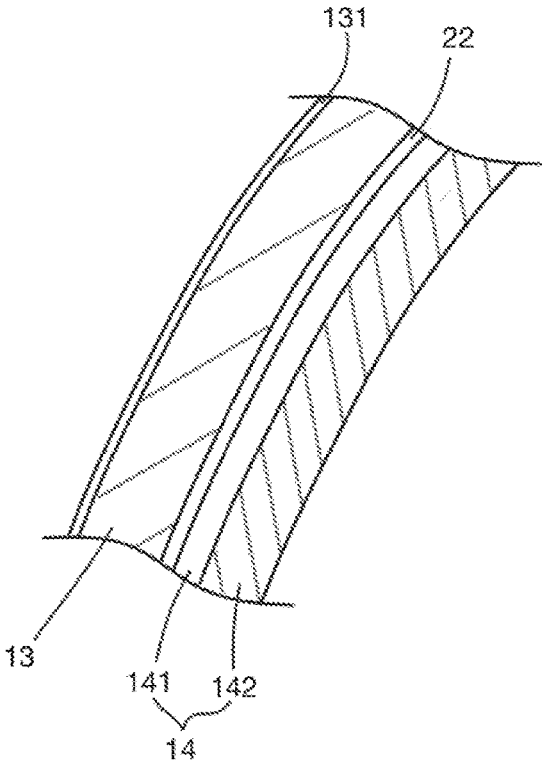

The inner layer 14 may optionally include an additional layer of lightweight viscoelastic foam 141 to absorb the impact energy from sudden impacts. A material that is particularly well suited for this purpose is an elastomeric, polyurethane viscoelastic open cell foam with a density between two and 15 pounds per cubic foot. When an additional layer of lightweight viscoelastic foam 141 is used in the inner layer 14, it is most effective when used as a sandwich layer within the gel-like viscoelastic foam 142 (as shown in FIG. 7A) or used between the gel-like viscoelastic foam 142 and the rigid core 22 (as shown in FIG. 7B). While the use of viscoelastic foam has been disclosed as the preferred embodiment, it is appreciated that other materials with similar impact absorbing and density properties would also be suitable for this application.

In the present invention, the rigid core 22 is comprised of a carbon fiber reinforced polymer ("carbon fiber"). Carbon fibers, when combined with a plastic resin, form the composite commonly known as carbon fiber, a material that is particularly strong for its weight. Because of carbon fiber's high strength to weight ratio, it is particularly well suited for use as the rigid core 22 in the present invention. A lightweight material is advantageous in a helmet because it reduces the mass located about a player's head, therefore reducing the magnitude of impacts.

While carbon fiber is well suited for use as the rigid core 22, it is appreciated that there are multiple materials that would be suitable. For instance, Exotex® Dacron has a high strength to weight ratio that exceeds that of carbon fiber and would also be an ideal material for the rigid core 22 when combined with a plastic resin. Other type of basalt fiber based composite materials would have similar high strength and low weight characteristics. The purpose of the rigid core 22 is to provide structure to the helmet 10 and many materials could be suitable based on the desired weight, crush resistance and cost of the helmet.

In the preferred embodiment, the outer layer 13 is comprised of a layer of lightweight viscoelastic foam to absorb the impact energy from sudden impacts on the exterior of the helmet. A material that is particularly well suited for this purpose is an elastomeric, polyurethane viscoelastic open cell foam with a density between two and 15 pounds per cubic foot. It is appreciated that other materials with impact absorbing properties would be suitable for use as the outer layer 13. While a viscoelastic foam is used in the preferred embodiment, other materials capable of absorbing high impact energy would also be suitable.

To increase the water resistance of the outer layer 13, a waterproof coating may optionally be applied. Various waterproof coatings would be suitable, including, but not limited to, room temperature vulcanization silicone. To increase the abrasion resistance of the outer layer 13, the outer surface may optionally be wrapped with a flexible abrasion resistant material 131, such as a fiber reinforced cloth. Various reinforced materials would be suitable, including, but not limited to, Exotex® Dacron cloth.

In the preferred embodiment, the apex 19 on the exterior of the helmet is formed by increasing the thickness of the outer layer 13 in the area of the apex. Increasing the thickness of only the outer layer 13 allows the rigid core 22 and inner layer 14 to remain molded to the shape of a user's head as a user does not typically have an apex protruding from their head in the area of apex 19. Building up the outer layer 13 provides additional impact absorption material in the area of the apex and provides a helmet shape that is less likely to produce an elastic collision when compared to a helmet with a nearly spherical exterior.

Figure 6:
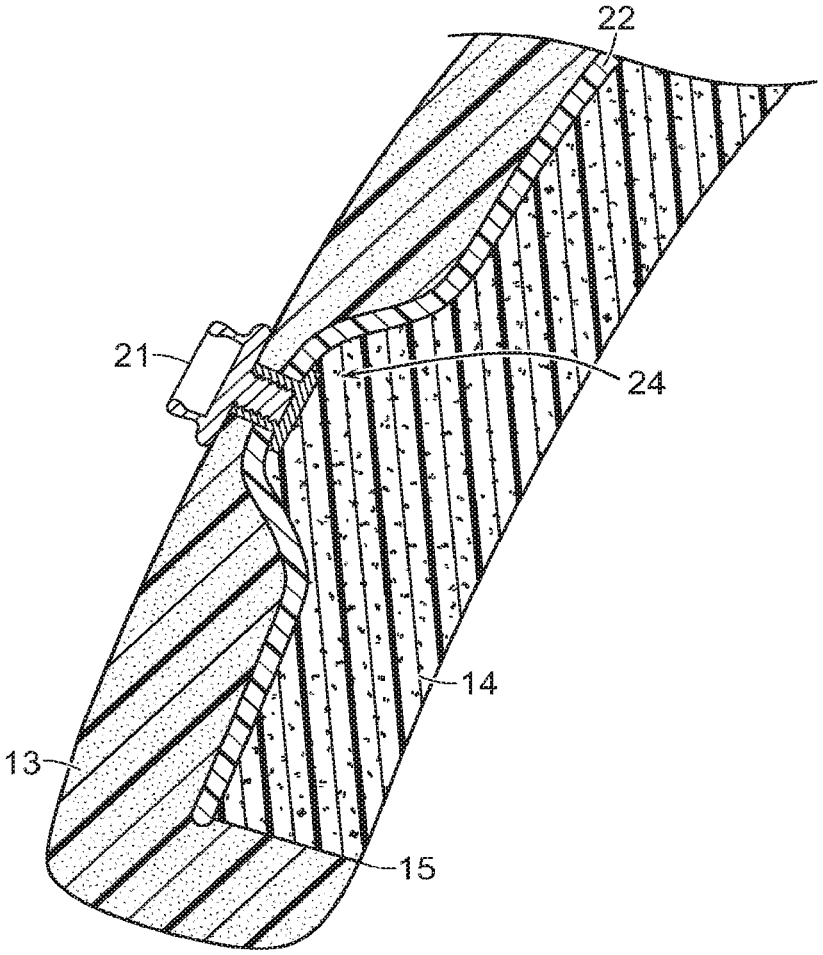
FIG. 6 is a sectioned view of the invention at a facemask anchor point showing the layers used in the invention and the edge detail.

In FIG. 6 is a side sectioned view of a helmet mounted snap 21 showing the mounting detail and the edge detail of the helmet. The helmet mounted snaps 21 are mounted to the rigid core 22. To position the helmet mounted snaps at an effective height beyond the outer layer 13, the rigid core contains circular extrusions 24 that extend towards the outside of the helmet. The circular extrusions 24 have the added benefit of moving the mounting hardware for the helmet mounted snaps 21 further from a user's head.

The outer layer 13 is mounted to the outer surface of the rigid core 13 and extends around the edge of the helmet. The inner layer 14 is mounted to the inner surface of the rigid core 13 and meets the outer layer 14 at seam 15 running along the inside edge of the helmet.

What has been described is a football helmet designed to reduce the occurrence of concussions and the magnitude of subconcussive impacts to the head. While this disclosure shows the invention as a football helmet, all or part of the invention is capable of being used in other applications. In this disclosure, there is shown and described only the preferred embodiment of the invention, but, as aforementioned, it is to be understood that the invention is capable of use in various other combinations and environments and is capable of changes or modifications within the scope of the inventive concept as expressed herein.

The invention claimed is:

1. A helmet comprising:

a rigid layer capable of being worn over a user's head;

an inner layer fixed to an inside surface of the rigid layer and capable of absorbing impact energy; and an outer layer fixed to an outside surface of the rigid layer and capable of absorbing impact energy, and wherein each of said inner and outer layers comprises a plurality of grooves for allowing flexure of the helmet in a vicinity of a neck of the user, and wherein said rigid layer ends at a point above said plurality of grooves and said inner and outer layers extend below said point.

2. The helmet of claim 1, wherein said inner layer has a density between 15 and 50 pounds per cubic foot.

3. The helmet of claim 2, wherein said outer layer has a density between two and 15 pounds per cubic foot.

4. The helmet of claim 1, wherein said inner layer comprises a viscoelastic foam.

5. The helmet of claim 4, wherein said outer layer comprises a viscoelastic foam.

6. The helmet of claim 5, wherein the viscoelastic foam of said inner layer has an open-cell structure and is capable of molding to the contour of the head of the user wearing said helmet.

7. The helmet of claim 6, wherein the viscoelastic foam of said outer layer has an open-cell structure and is capable of absorbing high impact energy.

8. The helmet of claim 7, wherein said inner layer has a density between 15 and 50 pounds per cubic foot.

9. The helmet of claim 8, wherein said outer layer has a density between two and 15 pounds per cubic foot.

10. The helmet of claim 9, wherein said inner layer further comprises an additional layer of viscoelastic foam with a density between two and 15 pounds per cubic inch.

11. The helmet of claim 10, wherein said helmet further comprises a layer of abrasion resistant material fixed to an outer surface of said outer layer.

12. The helmet of claim 11, wherein said abrasion resistant material comprises a polyester material.

13. The helmet of claim 11, wherein said abrasion resistant material comprises carbon fiber cloth.

14. The helmet of claim 11, wherein said rigid layer further comprises carbon fiber.

15. The helmet of claim 14, wherein said outer layer has a cone shaped peak with a rounded apex.

16. The helmet of claim 15, wherein said apex is located on top of a centerline of the helmet when viewed from a front of the helmet.

17. The helmet of claim 16, further comprising two ear holes, each ear hole located substantially over a respective ear of the user when the user is wearing said helmet;

wherein said apex is located at rear of a vertical line drawn from the center of one ear hole when said helmet is upright and viewed from a side of the helmet.

18. The helmet of claim 17, wherein when said helmet is upright and viewed from the side, when a line is drawn between one ear hole and said apex, the angle between the line drawn and the vertical line of claim 17 is between zero and 35 degrees.

19. The helmet of claim 1, wherein one or more of said grooves have a curved profile.

* * * * *